US006817206B2

(12) United States Patent
Shahbaz

(10) Patent No.: US 6,817,206 B2
(45) Date of Patent: Nov. 16, 2004

(54) AIR CONDITIONING APPARATUS FOR ISOLATED SPACES

(76) Inventor: Jamshid Jim Shahbaz, 993 Aranmoor Ave., Westlake Village, CA (US) 91361

( * ) Notice: Subject to any disclaimer, the term of this patent is extended or adjusted under 35 U.S.C. 154(b) by 0 days.

(21) Appl. No.: 10/461,966

(22) Filed: Jun. 12, 2003

(65) Prior Publication Data

US 2003/0205055 A1 Nov. 6, 2003

Related U.S. Application Data

(63) Continuation-in-part of application No. 09/895,628, filed on Jul. 2, 2001, now abandoned.

(51) Int. Cl.[7] ..... F25B 23/12
(52) U.S. Cl. ..... 62/331; 67/305
(58) Field of Search ..... 67/305, 310, 314, 67/331

(56) References Cited

U.S. PATENT DOCUMENTS 2,786,406 A * 3/1957 White ..... 454/157
4,029,723 A * 6/1977 Morrison et al. ..... 261/29
4,234,526 A * 11/1980 Mackay et al. ..... 261/106
4,369,148 A * 1/1983 Hawkins ..... 261/36.1
4,752,419 A * 6/1988 Sperr et al. ..... 261/29
4,798,060 A * 1/1989 Long et al. ..... 62/310
6,134,905 A * 10/2000 Collins et al. ..... 62/310

* cited by examiner

*Primary Examiner*—Melvin Jones
(74) *Attorney, Agent, or Firm*—William L. Chapin

(57) ABSTRACT

An air conditioning apparatus for isolated interior spaces of structures includes a hollow tubular-shaped enclosure which has a longitudinally elongated box-like shape. The enclosure has a transversely disposed inlet opening, a transversely disposed outlet opening, and a fan for drawing air through the enclosure from the inlet side, the air being expelled from an outlet port in the outlet opening of the enclosure. The enclosure also includes an air filter, at least one evaporator connected to a refrigerant compressor and refrigerant-to-water heat exchanger/condenser, and an evaporative cooler assembly including a plurality of nozzles for converting water supplied under pressure to the nozzles to fine spray. Water supplied to and warmed by thermal contact with pressurized refrigerant in the water heat exchanger, as well as excess water spray which does not evaporate, is discharged to a location exterior to the enclosed space, such as a sewer drain, thus dumping heat energy to the exterior location.

31 Claims, 13 Drawing Sheets

AIR CONDITIONING APPARATUS FOR ISOLATED SPACES

RELATED APPLICATION INFORMATION

The present application is a continuation-in-part of application Ser. No. 09/895,628, filed Jul. 2, 2001 now abandoned.

BACKGROUND OF THE INVENTION

A. Field of the Invention

The present invention relates to equipment and apparatus used for controlling properties of air in structures occupied by people or animals. More particularly, the invention relates to an air conditioning apparatus for controlling the temperature and humidity of air within enclosed spaces such as interior rooms of a building or other structure.

B. Description of Background Art

Heating, ventilating and air conditioning (HVAC) systems for controlling the interior environment of buildings and other structures occupied by humans utilize a variety of well known equipment and apparatus for conditioning air within the structure to comfortable temperatures and humidity levels and to remove air-borne pollutants including particulates such as dust.

Heating the interior space of a building is a relatively straight forward task, since latent energy sources such as electricity, gas, oil, or coal are readily input into a heater or furnace within the building, or by conveying working fluid heated by solar panels or the earth into the building to raise the temperature to a desired value. Cooling a building is more problematic, since that task requires expenditure of energy to exhaust heat from the building and also generally requires relatively large heat exhaust ducts and heat exchangers to dump the removed heat energy into an environment exterior to the building. Thus, room air conditioners are typically installed in a window opening, with the condenser portion of closed-cycles, pressurized refrigerant systems being located exterior to the room, where heat is exhausted to the atmosphere by the condenser, primarily by forced convection and secondarily by passive convection and black-body radiation.

In certain situations, it is desired to provide means for temporarily cooling a room. In response to this application, a variety of "portable air conditioners" have been made available. However, most of these utilize a flexible air duct for conducting warm air to a region exterior to the room. Such ducts are typically coupled to a window opening to the outside of the building. Aside from the inconvenience of having to couple a flexible air duct temporarily to a window opening, such openings are unavailable in interior rooms of a structure. The present invention was conceived of to provide a convenient means for cooling and conditioning air within an isolated space such as the interior of an inner room within a building or other structure.

OBJECTS OF THE INVENTION

An object of the present invention is to provide an air conditioning apparatus for cooling air within isolated spaces.

Another object of the invention is to provide an air conditioning apparatus for cooling and/or dehumidifying air within an isolated space.

Another object of the invention is to provide an air conditioning apparatus for selectably cooling, humidifying, dehumidifying, and filtering air within an interior space of a structure.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an air conditioning apparatus for isolated interior spaces, such as a space within an inner or windowless room of a structure such as a building. With all access openings, such as doorways to an interior spaced closed, the space may be referred to as "quasi hermetically isolated." An air conditioning apparatus for isolated spaces according to the present invention includes a box-like cooling enclosure which includes means for drawing air from the interior space of a room through the box, means for filtering particulates from the air, means for cooling the air, means for selectably humidifying or dehumidifying the air, and means for expelling conditioned air into the interior space of the room.

A preferred embodiment of the present invention includes at least one evaporative cooler assembly which comprises a plurality of spray nozzles that are supplied with water under pressure, the nozzles spraying water into a stream of air flowing against the direction of the spray streams. In a preferred embodiment, water is supplied to the spray nozzles from a source such as a kitchen faucet, and discharged to a location exterior to a space air-conditioned by the apparatus, such as a sewer drain. The air conditioning apparatus according to the present invention also preferalby includes at least one closed-cycle refrigeration assembly which uses a pressurized refrigerant such as Freon.

According to the invention, the closed-cycle refrigeration assembly includes a compressor having a discharge line which is input to a refrigerant-to-water heat exchanger or condenser that includes a serpentinely coiled pressurized refrigerant tube which is in thermally conductive contact with water which flows through a housing containing the coil. In a preferred embodiment, cooling water for the water heat exchanger is supplied from a source such as a kitchen faucet, and is discharged to a location exterior to a space air conditioned by the apparatus, such as a sewer drain.

Pressurized liquid refrigerant cooled by the refrigerant-to-water heat exchanger is preferably further cooled by a pressurized liquid refrigerant-to-suction line heat exchanger. Cooled, pressurized liquid refrigerant is conveyed by a capillary tube to the inlet port of a closed, pressurized evaporator unit within the cooling box. Serpentine cooling coils within the evaporator unit have a larger flow cross section than the pressurized liquid refrigerant capillary tube, whereby liquid refrigerant in the pressurized capillary tube expands into the evaporator coils and produces a cooling effect, thus cooling air which is drawn through the coils by a fan. Refrigerant is drawn from an outlet port of the evaporator unit by a suction line which is coupled to a suction inlet port of the compressor, and as stated above, which is preferably thermally coupled to the capillary refrigerant inlet line by a refrigerant-to-suction line heat exchanger.

A preferred embodiment of an air conditioning apparatus according to the present invention includes a perforated spray eliminator plate disposed transversely to the air flow direction in the cooling box, and upstream of the conditioned air exhaust port. The spray eliminator plate is effective in removing a portion of water droplets which may be entrained in the cooled air stream. Optionally, one or more additional spray eliminator plates may be included in the cooling box to remove additional entrained water droplets, and to control air flow. By operating the spray evaporative cooler assembly when the ambient air is sufficiently dry, evaporative cooling and humidification are accomplished. If additional cooling, and/or dehumidification is desired, one or more of the pressurized refrigerant compressors may be turned on, thus further cooling and dehumidifying exhausted air. Importantly, heat removed from air flowing through the cooling box is transferred to a water stream which is discharged into an external location such as a sewer drain, thus enabling the apparatus according to the present invention to effectively cool an isolated interior space of a building or other structure which may be isolated or even quasi-hermetically sealed.

DESCRIPTION OF THE PREFERRED EMBODIMENTS

Figure 1:
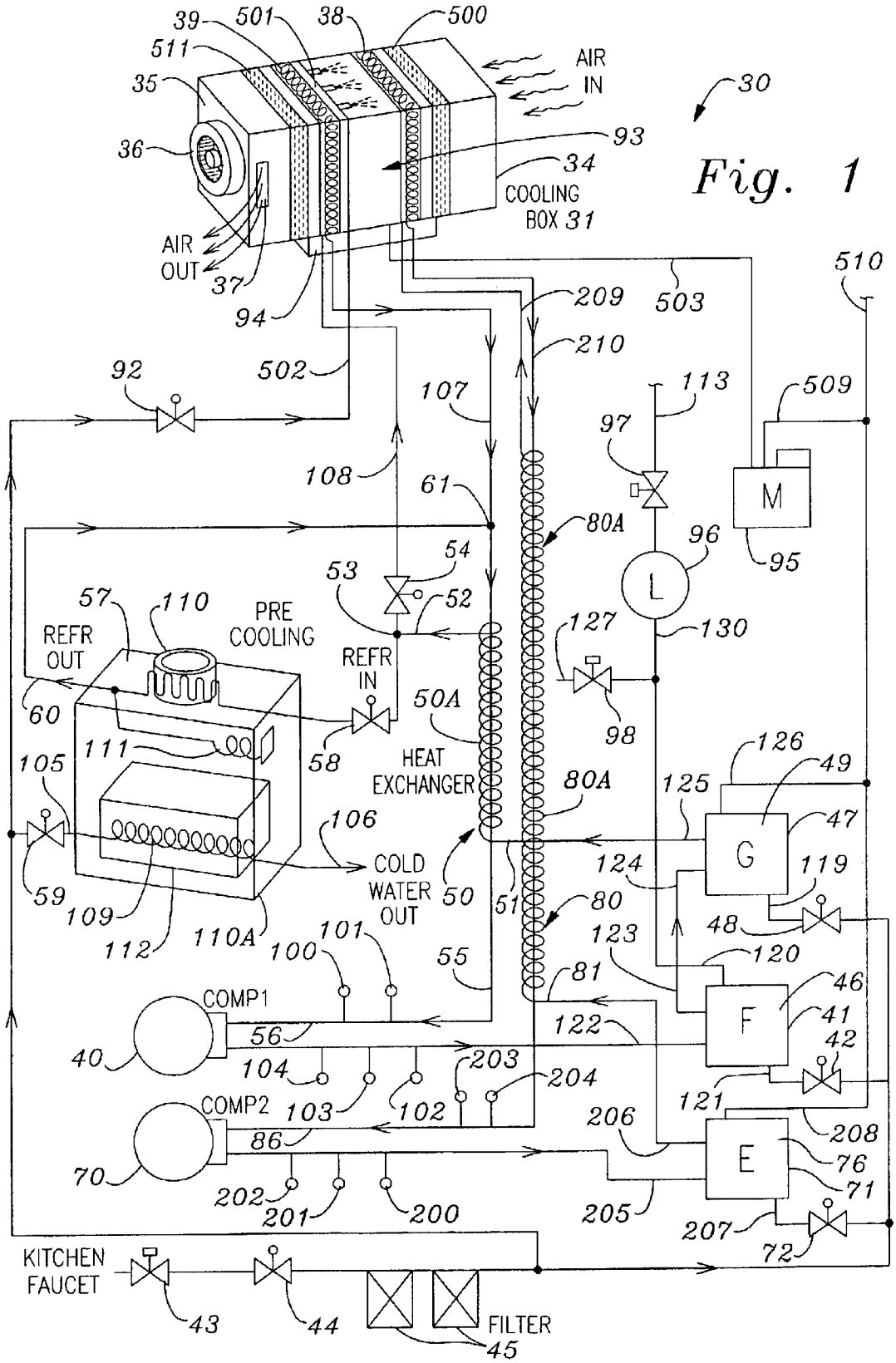
FIG. 1 is a partly schematic view of a basic embodiment of an air conditioning apparatus according to the present invention, which includes two closed cycle refrigeration units and one evaporative cooler.
Figure 2:
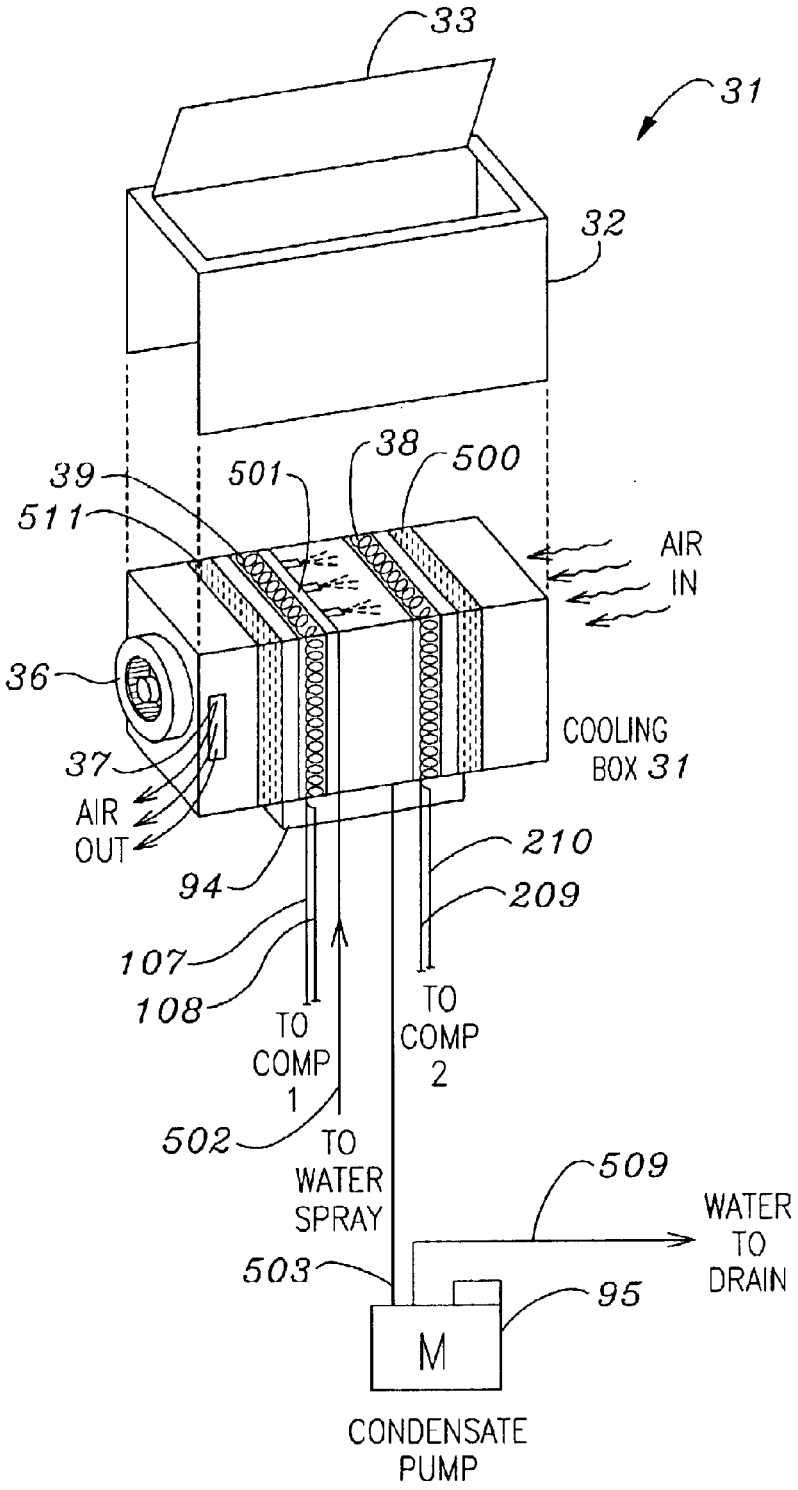
FIG. 2 is a fragmentary view of the apparatus of FIG. 1 showing details of a cooling box thereof.

Referring first to FIGS. 1 and 2, a basic embodiment of an air conditioner apparatus 30 for isolated spaces according to the present invention may be seen to include a block-shaped, box-like cooling enclosure 31 over which fits a removable shroud 32 which has a hinged lid 33 that affords access to the interior of the box. Cooling box 31 has a shape which approximates that of a longitudinally elongated rectangular parallelepiped and includes a transversely disposed inlet side 34, a transversely disposed outlet side 35, and a fan 36 for drawing air through the box from the inlet side, the air being expelled from an outlet port 37 of the box. Cooling box 31 also includes an air filter 500, an upstream pressurized evaporator 38, an evaporative cooler spray nozzle assembly 501, a second, downstream pressurized evaporator 39, and a perforated spray eliminator plate 511, all of which elements are arranged in the aforementioned sequence between the inlet and outlet sides of the box.

Figure 6:
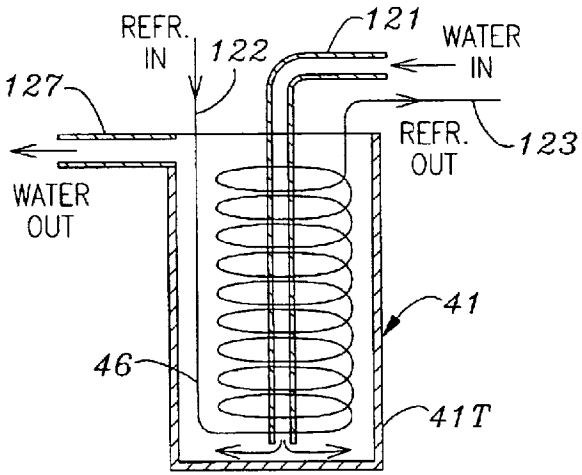
FIG. 6 is a partly schematic sectional view of a water condenser/heat exchanger component of the apparatus of FIGS. 1, 4, and 5 in which the output water is relatively warm.

Referring to FIG. 1, it may be seen that apparatus 30 includes a downstream refrigerant compressor 40 which has a high pressure discharge line 122 that conducts pressurized refrigerant to a first refrigerant-to-water heat exchanger/condenser 41. As shown in FIG. 1, heat exchanger/condenser 41 has a water inlet port 121 which is connected through a valve 42 to a water supply which includes a kitchen faucet 43, a valve 44 and a water filter 45. As shown in FIG. 6, water heat exchanger/condenser 41 includes a serpentinely coiled refrigerant tube 46 through which pressurized refrigerant is conducted from pressurized inlet line 122 to a pressurized outlet line 123. Refrigerant within coil 46 is cooled by thermally conductive contact of the coil with flowing water introduced into heat exchanger 41 through inlet port 121 and exiting from the heat exchanger via outlet port 123. As shown in FIG. 1, pressurized refrigerant exiting through outlet port 123 of refrigerant-to-water heat exchanger 41 is preferably further cooled by a second water heat exchanger/condenser 47. The latter has a construction similar to that of first water heat exchanger 41, and includes a water inlet port 119, water inlet valve 48, refrigerant coil 49, water outlet port 126, refrigerant inlet port 124, and refrigerant outlet port 125.

As shown in FIG. 1, pressurized refrigerant exiting from outlet port 125 of second water heat exchanger/condenser 47 preferably is further cooled by a pressurized refrigerant-to-suction line heat exchanger 50. The latter has an inlet port 51 and an output port 52 from which cooled, pressurized liquid refrigerant is conducted to a Tee fitting 53, one outlet port of which is connected through a valve 54 to a refrigerant capillary inlet line 108 to downstream pressurized refrigerant cooling evaporator 39 in cooling box 31. Downstream pressurized refrigerant cooling evaporator 39 has an outlet discharge line 107 which passes through pressurized refrigerant-to-suction line heat exchanger 50 to a low pressure or suction inlet port 56 of compressor 40. Heat exchanger 50 includes a length of pressurized capillary tubing 50A wrapped in a helix around low-pressure suction line 55, in thermally conducted contact therewith.

Referring still to FIG. 1, it may be seen that air conditioning apparatus 30 optionally includes a refrigerator and drinking water cooler 57 which receives pressurized, cooled liquid refrigerant supplied by a second outlet port of Tee 53 through a valve 58. Refrigerator water cooler 57 includes a serpentine evaporator coil 110, thermostat control coil 111, and a serpentine tubular water conduit 109 which has an outlet port 106 and an inlet port 105 connected through a valve 59 to water supply filter 45. Refrigerant discharged from water cooler evaporator coil 110 is conducted from outlet port 60 to an outlet Tee 61, where the refrigerant merges with refrigerant outlet discharge line 107 of cooling box 31 and is thence conducted to suction inlet port 56 of first compressor 40. Water cooled by water cooler 57 is output from outlet port 106, as desired for drinking.

Referring still to FIG. 1, air conditioning apparatus 30 according to the present invention optionally includes a second, upstream refrigerant compressor 70 which has a high pressure discharge line 205 that conducts pressurized refrigerant to a third, upstream refrigerant-to-water heat exchanger/condenser 71. As shown in FIG. 1, refrigerant-to-water heat exchanger/condenser 71 has a water inlet port 207 which is connected through a valve 72 to a water supply which includes kitchen faucet 43, valve 44 and water filter 45. Refrigerant-to-water heat exchanger/condenser 71 includes a serpentinely coiled refrigerant tube 76 through which pressurized refrigerant is conducted from pressurized inlet line 205 to a pressurized outlet line 206. Refrigerant within coil 76 is cooled by thermally conductive contact of the coil with flowing water which is introduced into heat exchanger 71 via inlet port 207 and which exits the heat exchanger via an outlet port 208.

As shown in FIG. 1, pressurized refrigerant exiting from outlet port 206 of heat exchanger/condenser 71 preferably is further cooled by a pressurized refrigerant-to-suction line heat exchanger 80. The latter has an inlet port 81 and an outlet port 82 from which cooled pressurized liquid refrigerant is conducted via a refrigerant inlet line 209 and to second, upstream pressurized refrigerant cooling evaporator 38 in cooling box 31. Upstream pressurized refrigerant cooling evaporator 38 has an outlet discharge line 210 which passes through second pressurized refrigerant-to-suction line heat exchanger 80 to a low pressure or suction inlet port 86 of second compressor 70. Heat exchanger 80 includes a length of pressurized capillary tubing 80 wrapped in a helix around low pressure suction line 210, in thermally conductive contact therewith.

Figure 16:
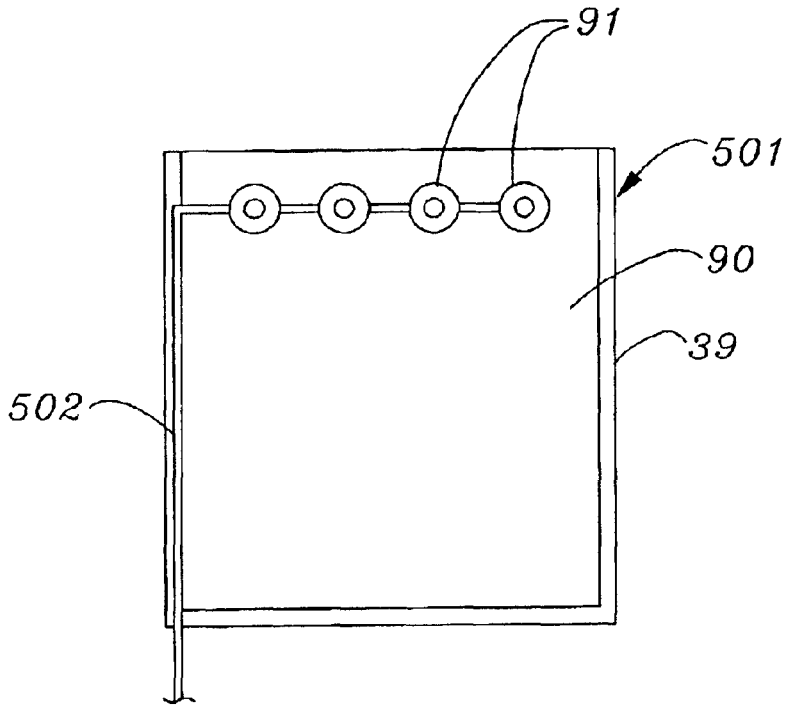
FIG. 16 is a fragmentary transverse sectional view of the cooling box portion of the apparatus shown in FIGS. 1, 4, and 5, showing water spray nozzles thereof.
Figure 17:
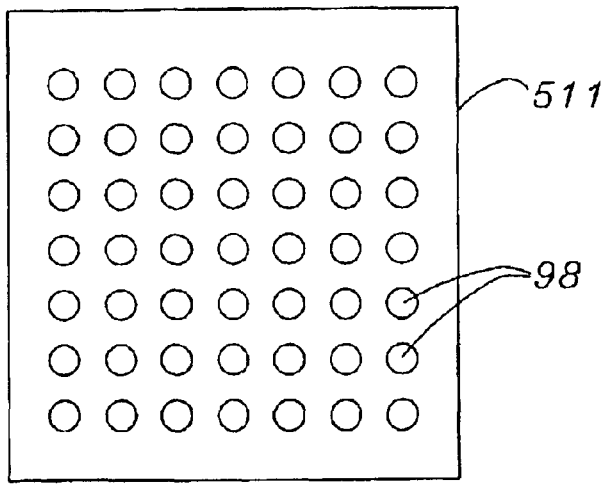
FIG. 17 is a fragmentary transverse sectional view of the cooling box portion of the apparatus shown in FIGS. 1, 4, and 5, showing a perforated spray eliminator plate thereof.

As shown in FIGS. 1 and 16, cooling box 31 includes an evaporative cooler assembly 501 which includes a support frame 90 that has protruding outwardly from an upper horizontally disposed member thereof, a plurality, e.g., four, of water spray nozzles 91, preferably arranged in a horizontal row. Nozzles 91 are supplied with pressurized water through a valve 92 and inlet supply pipe 502, from water filter 45. Water expelled in the form of spray from nozzles 91 into a plenum or air space 93 within cooling box 31 cools air within by evaporation. Water spray which does not evaporate is collected in a drip tray 94 and conducted through a drip tube 503 to a sump or condensate pump 95, and from pump 95 through an outlet discharge line 509 to a waste discharge or sewer line 510.

Figure 4:
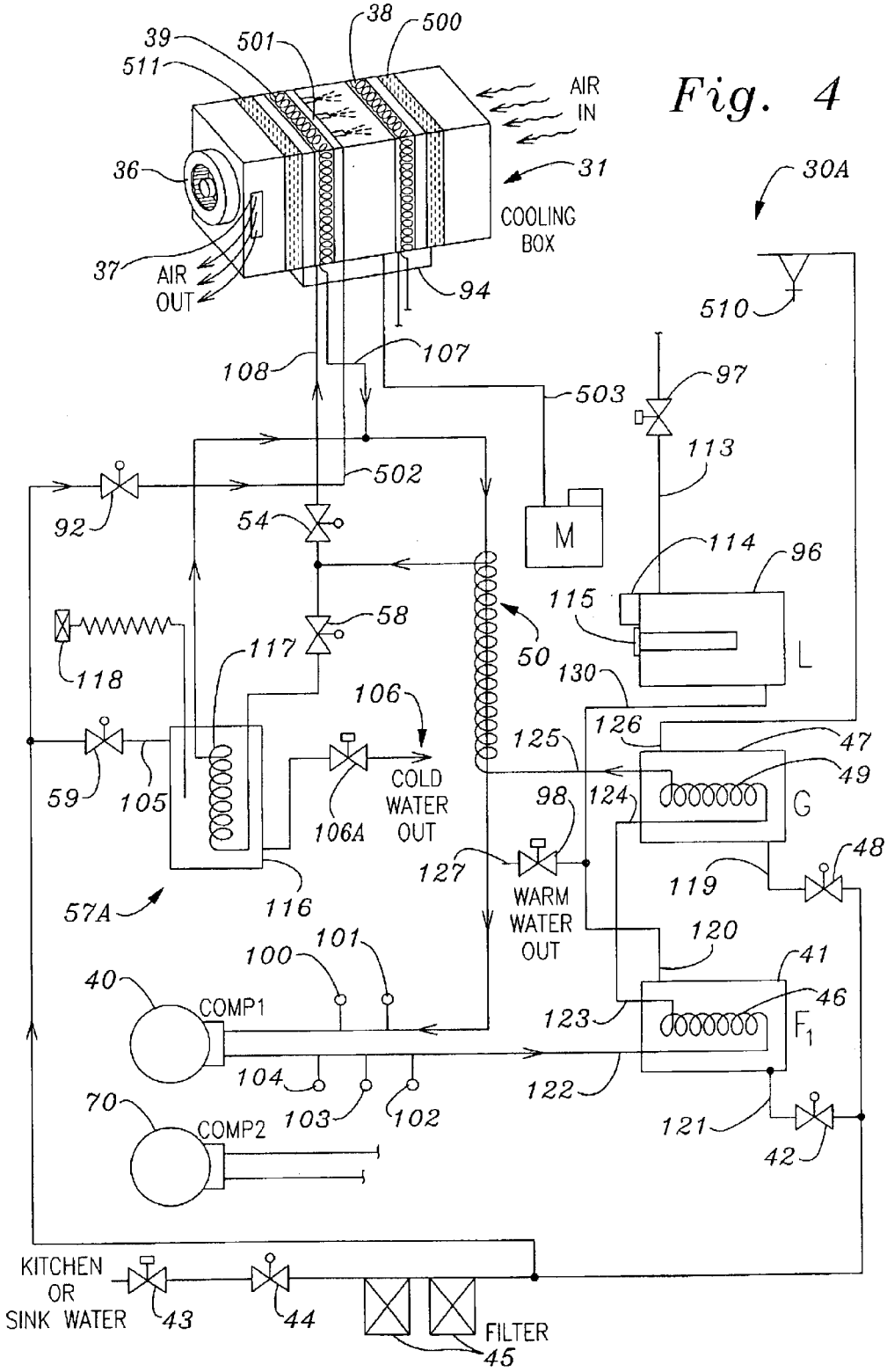
FIG. 4 is a partly schematic view of a second embodiment of an air conditioning apparatus according to the present invention, which employs a single, closed cycle refrigeration unit that includes a single downstream refrigerant evaporator and associated compressor.

Referring now to FIG. 4 in addition to FIG. 1, it may be seen that air conditioning apparatus 30 optionally includes a water heater 96 which has an inlet port 130 which is supplied with pre-heated water output from a refrigerant-to-water heat exchanger, such as heat exchanger 41. Water heater 96 includes an electrical heating element 115 which is connected through a temperature control thermostat 114 to a source of electrical power. Hot water is output from water heater 96 on an outlet port 113 through a hot water faucet 97. Desired quantities of pre-warmed, or tepid water supplied to water heater are available from heat exchanger 41 on outlet port 127 via a warm water faucet 98.

Referring still to FIG. 1, it may be seen that apparatus 30 includes on suction input line 56 of compressor 40, a low pressure control 100 which comprises a pressure sensor and switch that is connected in series with the compressor motor, and which interrupts electrical power to the motor if the pressure falls below a pre-determined minimum operating threshold value. Suction input line 56 is also provided with a low pressure refrigerant access port 101. High pressure outlet line 122 of compressor 40 is provided with a high pressure control 103 which comprises a pressure sensor and switch that is connected in series with the compressor motor, and which interrupts electrical power to the motor if the refrigerant pressure in the high pressure outlet line exceeds a pre-determined maximum operating threshold value. High pressure outlet line 122 also includes a pressure control solenoid valve 104, and a high pressure refrigerant access port 102.

Similarly, compressor 70 has a low pressure control 203, and low pressure access port 204 connected to suction line 86. Also, high pressure outlet line 205 of compressor 70 is provided with a high pressure control 201, pressure control solenoid valve 202 and high pressure access port 200.

Compressors 40, 70 are connected through control thermostats (not shown) to an electrical power source (not shown).

Operation of basic embodiment 30 of an air conditioning apparatus according to the present invention is as follows.

For relatively modest amounts of cooling required in an enclosed interior space such as an interior room of a building, when the temperature and humidity are not excessive, apparatus 30 may be operated in a solely evaporative cooling mode, in which water under normal domestic supply line pressure of about 50–100 psi is conducted to a plurality, of nozzles 91 mounted on spray evaporator support frame 90. Water issues from nozzles 91 in a fine, conical spray at a flow rate of ¼ to ½ GPM, per nozzle into plenum 93 of cooling box 31, cooling by evaporation air drawn by fan 36 into inlet side 34 of cooling box 31 through filter 500 and upstream refrigerant evaporator coils 38. Air cooled by evaporation of water spray in plenum 93 is drawn through coils of downstream refrigerant evaporator 39, through perforated spray eliminator plate 511, and discharged through cooling box output port 37 into a room or other enclosed space to be cooled. Air expelled from outlet port 37 of cooling box 31 is filtered by air filter 500, and cooled by evaporation of water issuing from spray nozzles 91. Moreover, excess moisture droplets entrained in air issuing from the downstream side of plenum 93 are removed by impact of the moist air with perforated spray eliminator plate 511, which optionally is in thermally conductive contact with a heat sink (not shown) maintained at ambient temperature or below.

Spray eliminator plate 511 has through its thickness dimension a plurality of holes 98 which have a diameter of about ⅛ to ¼ inch, and occupy about 70–90% of the area of plate 511.

Water spray droplets issuing from spray nozzles 91 into plenum 93 which do not evaporate or become entrained in flowing air fall into collection tray 94, flow into condensate pump 95 through drip line 503, and are discharged through discharge line 509 into sewer drain 510.

In those cases where a room is relatively humid, and/or when a greater degree of cooling is desired, one or both of compressors 40, 70 may be turned on, further cooling and de-humidifying air expelled from outlet port 37 of cooling box 31.

Figure 3:
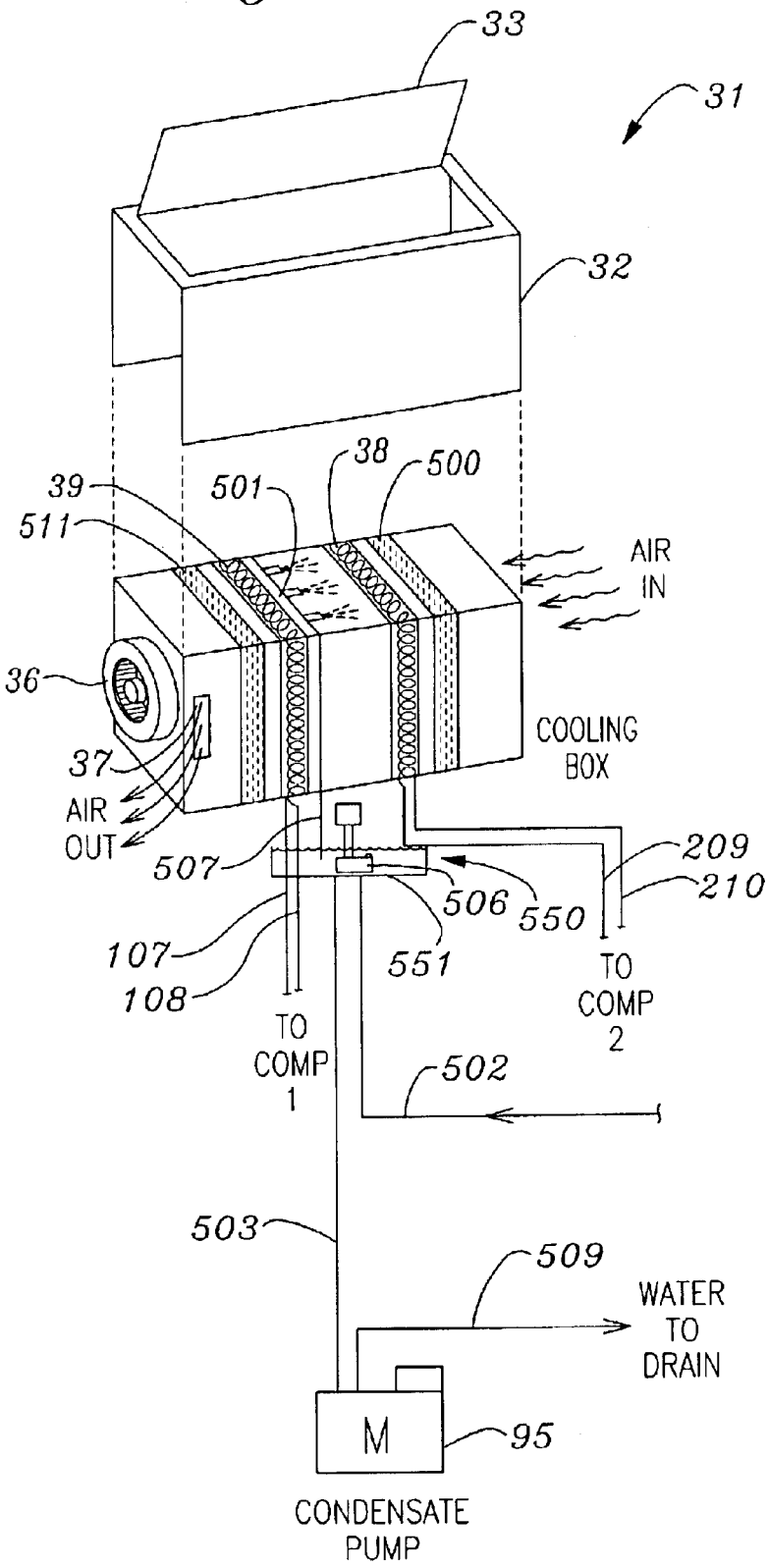
FIG. 3 is a fragmentary view of the apparatus of FIG. 1 showing details of a cooling box thereof, and a modified water supply for a water evaporator thereof.
Figure 10:
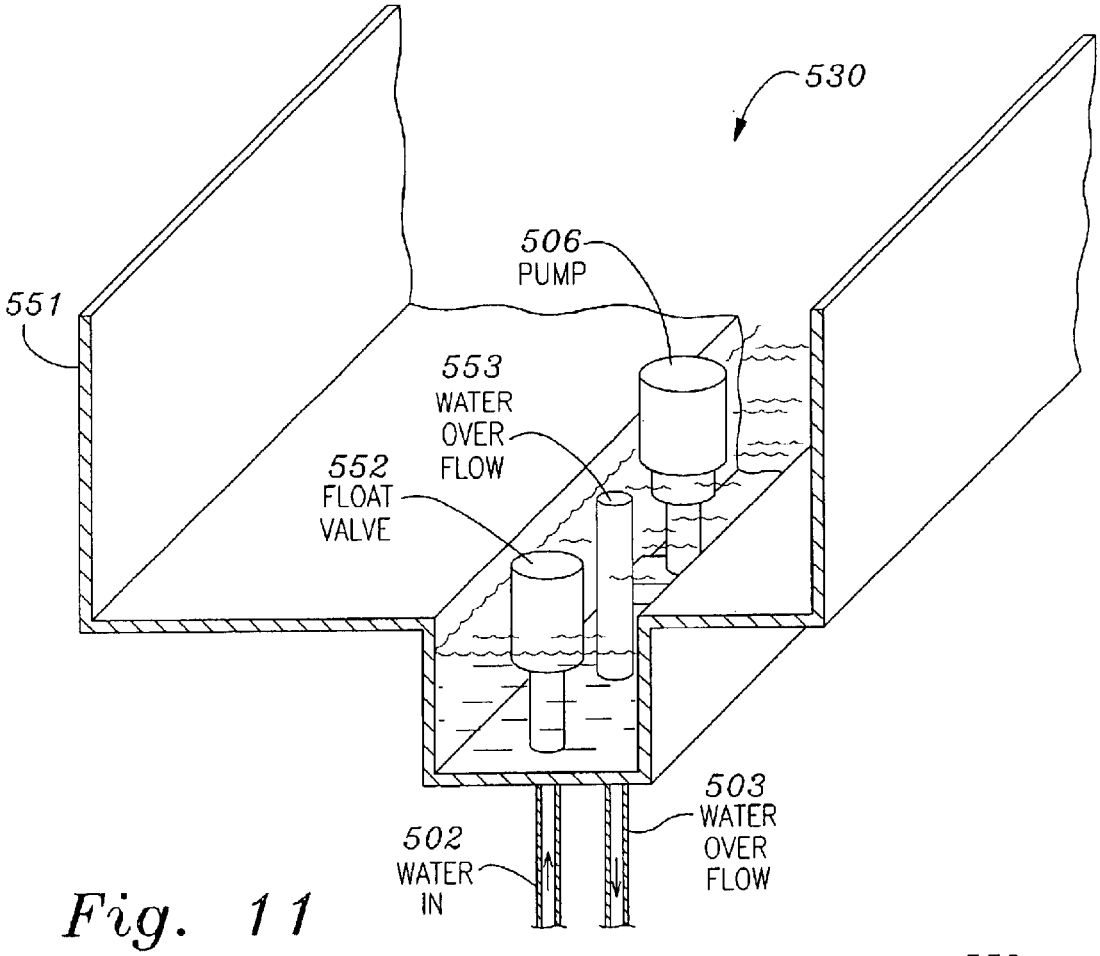
FIG. 10 is a fragmentary perspective view of a water supply component for the cooling box of FIG. 3.
Figure 11:
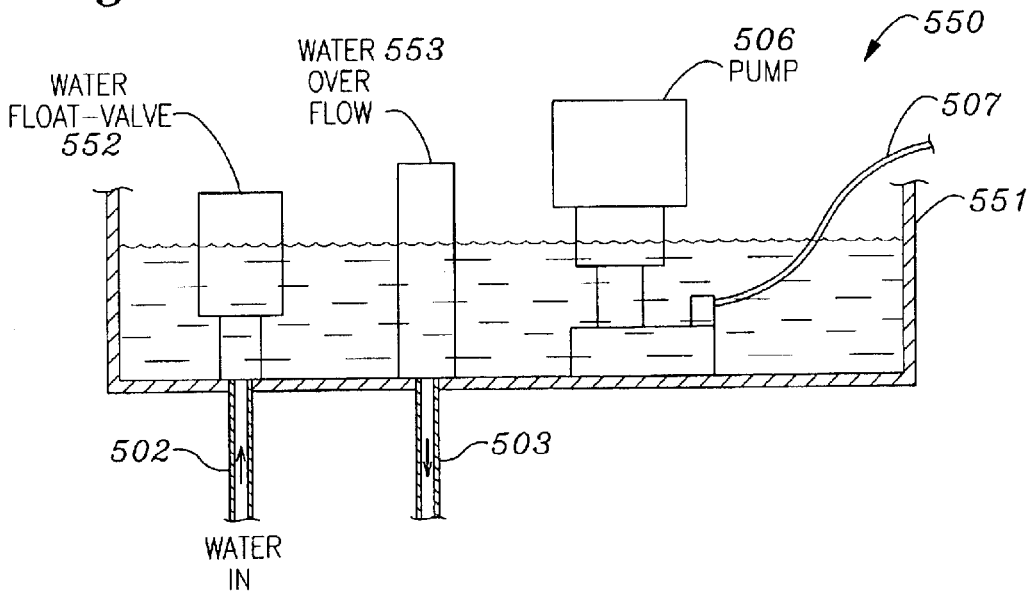
FIG. 11 is a longitudinal sectional view of the component of FIG. 10.

FIGS. 3, 10 and 11 illustrate a modified evaporator water supply unit 550 for cooling box 31. Modified evaporator water supply unit 550 includes a tank 551 which is integral with or replaces drip tray 94. Tank 551 is supplied with water which is maintained at a minimum pre-determined level by water supplied by water inlet line 502 through a float valve 552. Water above a pre-determined level within tank 551 is discharged into overflow pipe 553 and through outlet waste line 503. A submersible pump 506 within tank 551 provides pressurized water through line 507 to spray nozzles 508. In an example embodiment, pump 506 supplied water to nozzles 509 at a pressure of about 10–50 psi, and each of the four nozzles had a spray flow rate of about ¼ to ½ GPM.

FIG. 4 illustrates a second embodiment of an air conditioning apparatus 30A according to the present invention. In this embodiment, upstream refrigeration evaporator 38 and compressor 70 are optionally disconnected or absent from the apparatus. Also, embodiment 30A optionally includes a modified water cooler box which has a serpentinely coiled, pressurized refrigerant line 117 and an external water temperature control mechanism 118.

Figure 5:
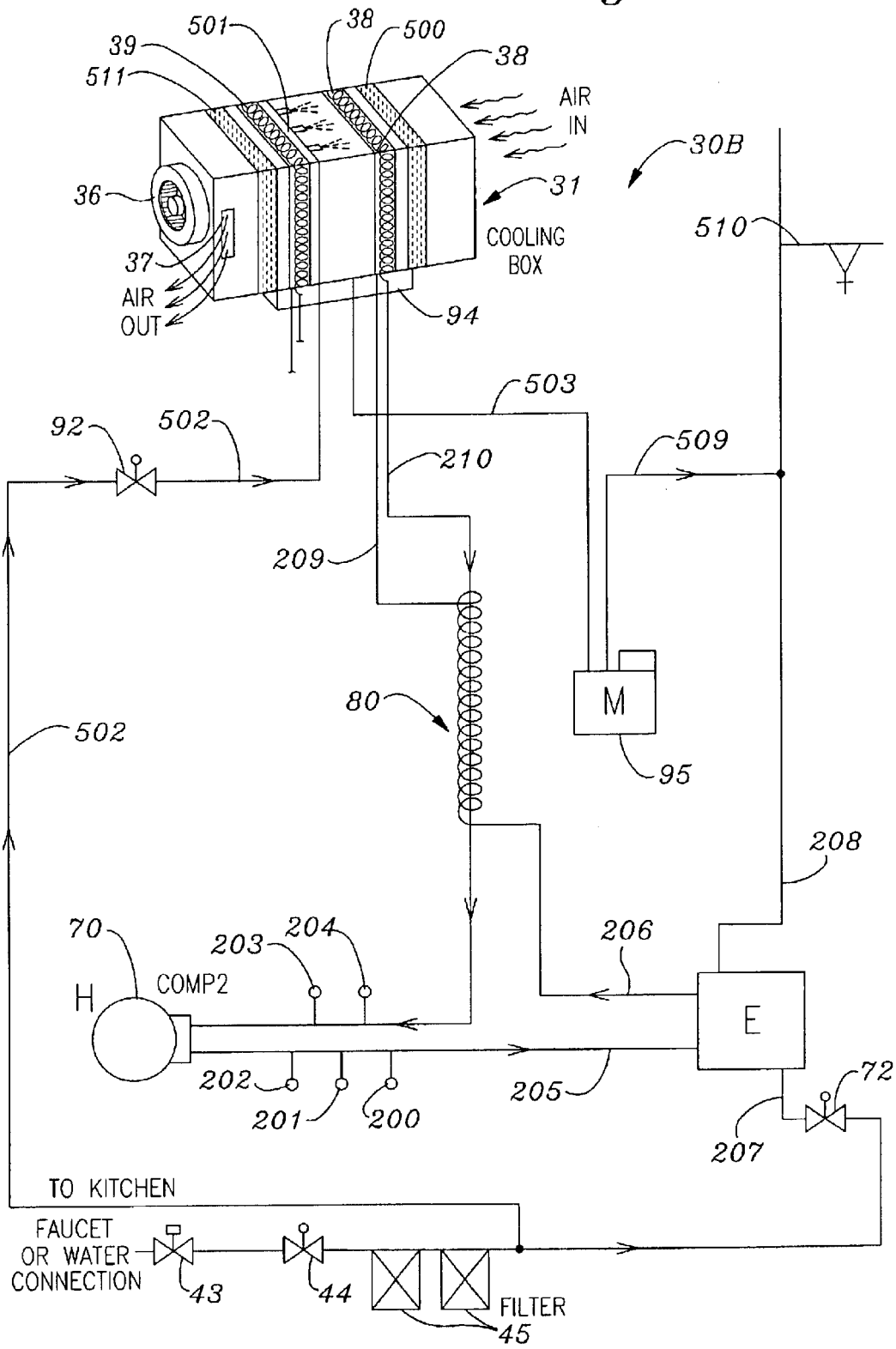
FIG. 5 is a partly schematic view of a third embodiment of an air conditioning apparatus according to the present invention, which employs a single, upstream refrigerant evaporator and compressor.

FIG. 5 illustrates a third embodiment of an air conditioning apparatus 30B according to the present invention, which uses a single, upstream evaporator 38 and compressor 70.

Figure 7:
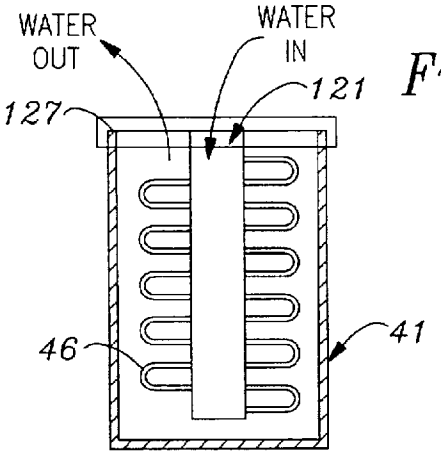
FIG. 7 is a more detailed sectional view of the condenser of FIG. 6.

FIGS. 6 and 7 illustrate a basic embodiment of a pressurized refrigerant-to-water heat exchanger according to the present invention. In this embodiment, flow of pressurized liquid refrigerant through enclosure tank 41T of water heat exchanger 41 is in a direction opposite to the direction of water flow through the tank. This arrangement results in relatively warm water issuing from the output port 127 of heat exchanger 41.

Figure 8:
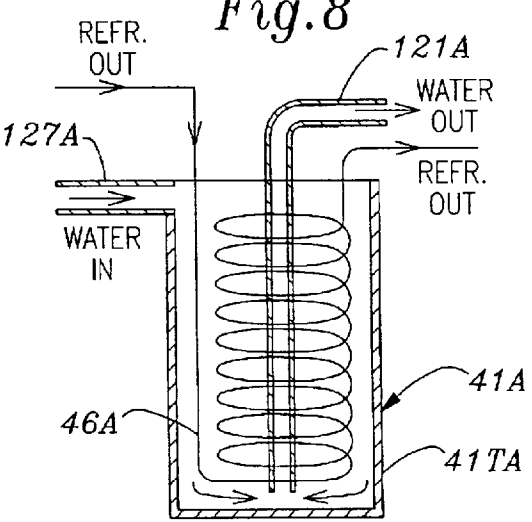
FIG. 8 is a partly schematic sectional view of a modification of the condenser of FIG. 6, in which waterflow is in the opposite direction from that of FIG. 6, producing output water that is relatively cooler than the water output from the condenser of FIG. 6.

FIG. 8 illustrates a modification 41A of water condenser 41 shown in FIGS. 6 and 7, in which the flow direction of water and refrigerant are the same, resulting in discharged water which is not as warm as for the embodiment shown in FIGS. 6 and 7.

Figure 9:
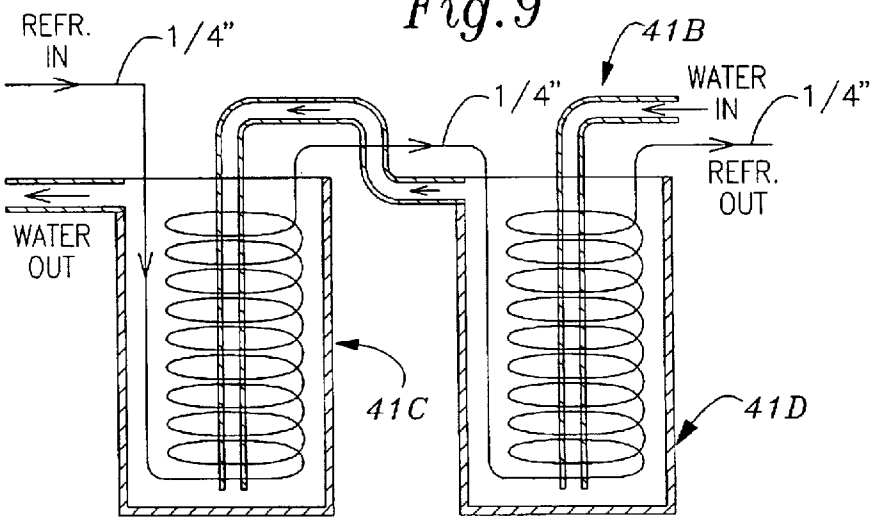
FIG. 9 is a partly schematic view of a pair of tandem condensers of the type shown in FIG. 6.

FIG. 9 illustrates another modification 41B of the water heat exchanger/condenser 41 shown in FIGS. 6 and 7. Modification 41B employs a pair of tandem heat exchangers 41C, 41D which are similar in construction and function to heat exchanger 41 shown in FIGS. 6 and 7. According to the present invention a tandem arrangement 41B employing two or more heat exchangers may be used when it is desired to achieve greater cooling of pressurized refrigerant.

Figure 13:
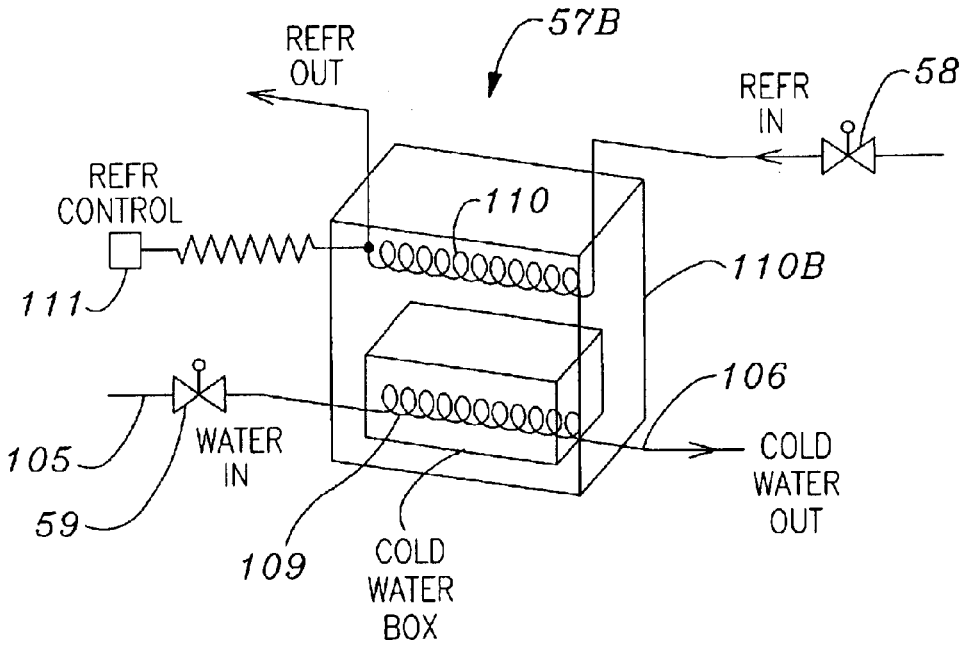
FIG. 13 is a fragmentary schematic view of the apparatus of FIG. 1, showing a refrigerator and water cooler component thereof.

FIG. 13 illustrates a second modification 57B of refrigerant and water cooler 57 shown in FIG. 1, which includes a serpentinely coiled refrigerant line 110, and a serpentinely cooled water line 109 which are contained in mutual thermally conductive contact within a thermally insulated enclosure box 110B.

Figure 14:
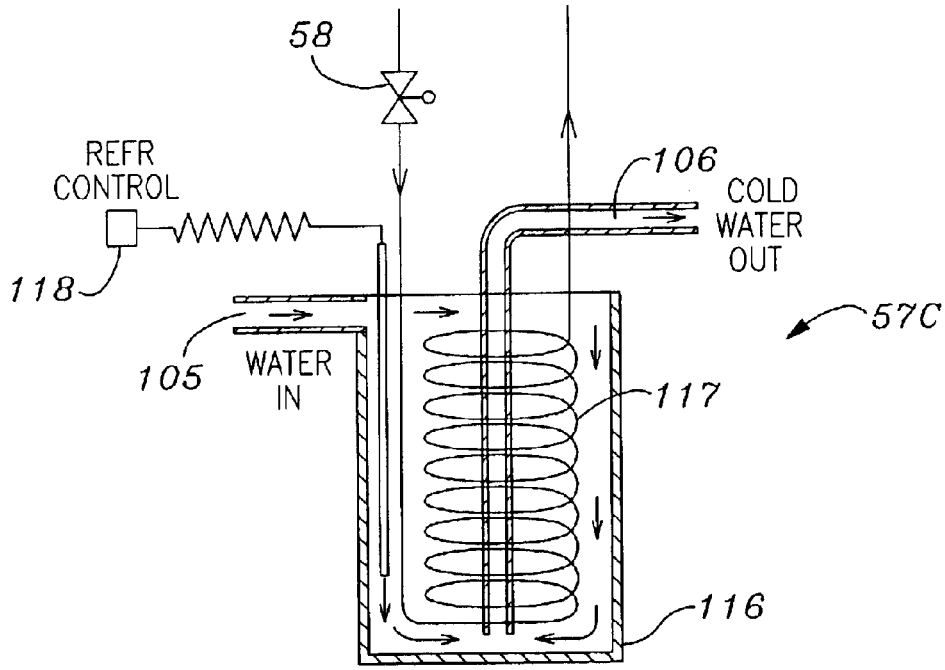
FIG. 14 is a partly schematic, partly sectional view of a water cooler component of the apparatus of FIG. 4.

FIGS. 4 and 14 illustrate a third modification 57C of water cooler unit 57 shown in FIG. 1, which includes a serpentinely coiled refrigerant line 117 in thermally conductive contact with water flowing through an enclosure 116 for the coiled line.

Figure 12:
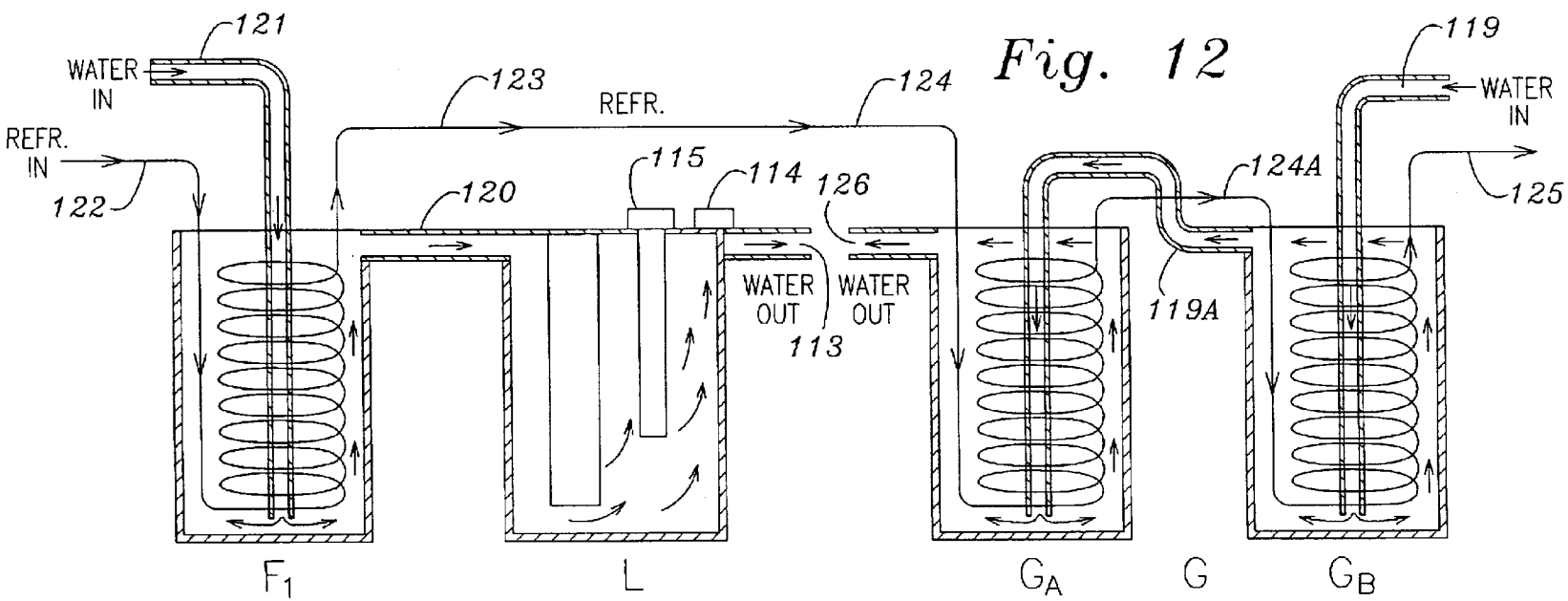
FIG. 12 is a fragmentary, partly schematic view of the air conditioning apparatus of FIG. 4, in which the single heat exchanger/condenser G thereof is replaced by a tandem condenser Ga–Gb.

FIG. 12 illustrates a modified refrigerant-to-water heat exchanger assembly for the air conditioning apparatus of FIG. 4, in which a heat exchanger G is comprised of a pair of tandem heat exchangers Ga, Gb.

Figure 15:
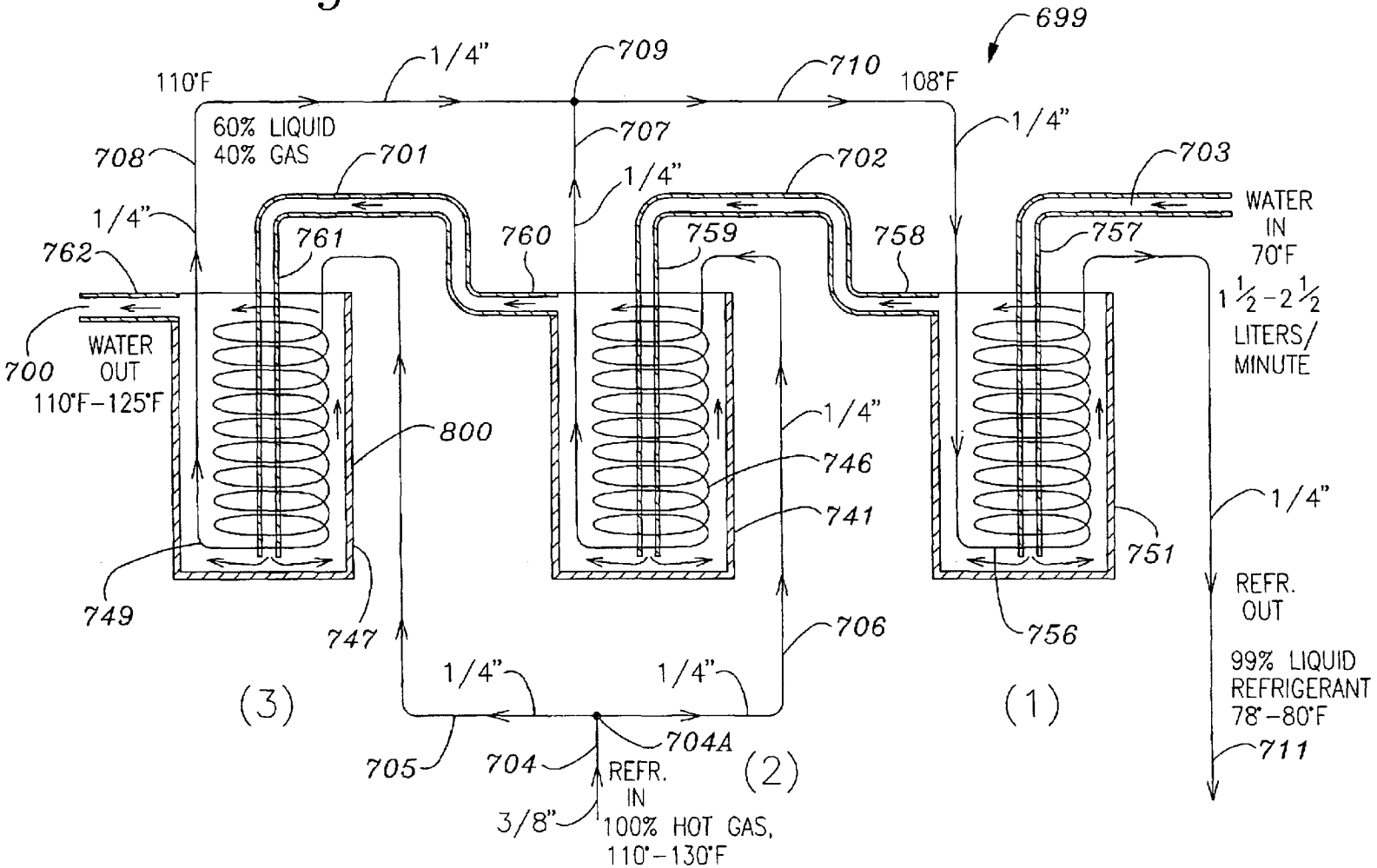
FIG. 15 is a partly schematic view of a modification of the water heat exchanger/condenser shown in FIGS. 1, 4, and 5, in which a single condenser is replaced by a triple tandem condenser.

FIG. 15 is a schematic view of a modification of the refrigerant-to-water heat exchanger/condensers shown in FIGS. 1, 4, and 5, in which a single heat exchanger is replaced by an assembly of three condensers arranged in a tandem sequence.

As shown in FIG. 15, modified heat exchanger assembly 699 includes an inlet pressurized refrigerant line 704 which is coupled to an inlet port of an inlet Tee 704A. The latter has outlet ports 705 and 706 which each conduct a portion, e.g., one half, of pressurized refrigerant carried by inlet line 704 to Tee 704A to separate, "middle" and "end", liquid-refrigerant water heat exchanger/condensers 741, 747, respectively. The latter include serpentinely coiled refrigerant tubes 746, 749, respectively, which have outlet lines 707, 708, respectively, which are coupled to separate inlet ports of an outlet Tee connection 709. The latter has an outlet port which is coupled to a line 710 that is an inlet tube to a third, "START" refrigerant-to-water heat exchanger 751. The latter includes a serpentinely coiled refrigerant tube 756 which is in thermally conductive contact with water flowing through heat exchanger 751. Refrigerant within coil 756 is cooled by thermally conductive contact with flowing water which is introduced into heat exchanger 751 via a water inlet port 703, the water exiting the heat exchanger via an outlet port 758. Water outlet port 758 of heat exchanger 751 is coupled via a line 702 to a water inlet port 759 of middle heat exchanger 741. The latter has a water outlet port 760 which is coupled by a line 701 to a water inlet port 761 of end heat exchanger 747, and water flowing through heat exchanger 747 is discharged via a water outlet port 762 to a water discharge line 700.

Figure 18:
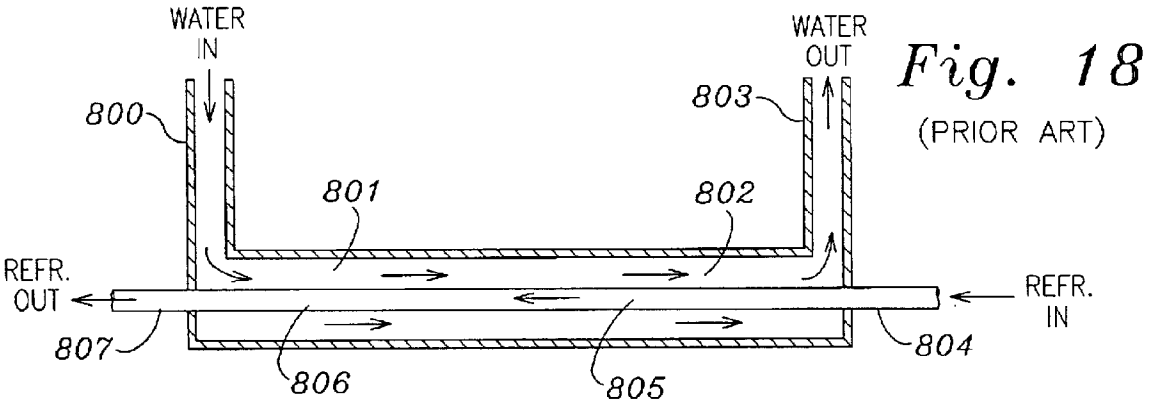
Fig. 18 (PRIOR ART)
FIG. 18 is a longitudinal sectional view of a prior art water heat exchanger.

It has been found that the tandem refrigerant-to-water heat exchanger assembly 699 according to the present invention provides a more efficient means of cooling pressurized liquid refrigerant than the coaxial tube arrangement of prior art heat exchangers, such as the prior art heat exchanger depicted in FIG. 18.

Figure 19:
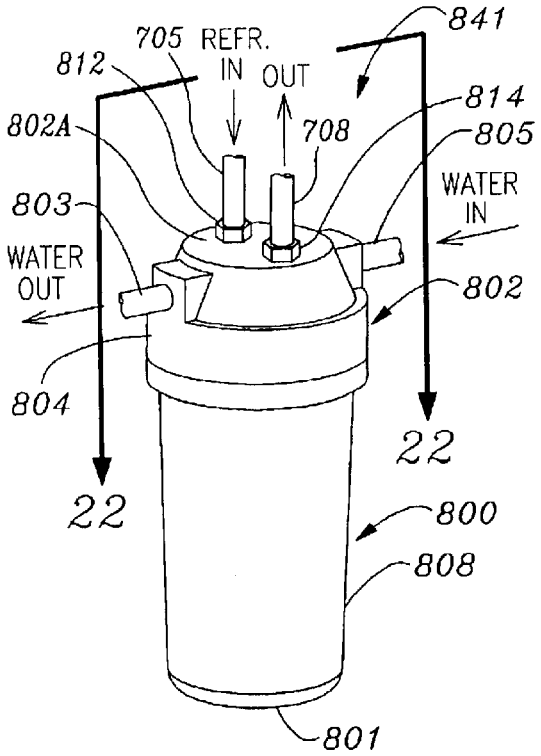
FIG. 19 is a perspective view of a modified refrigerant-to-water heat exchanger/condenser according to the present invention.
Figure 20:
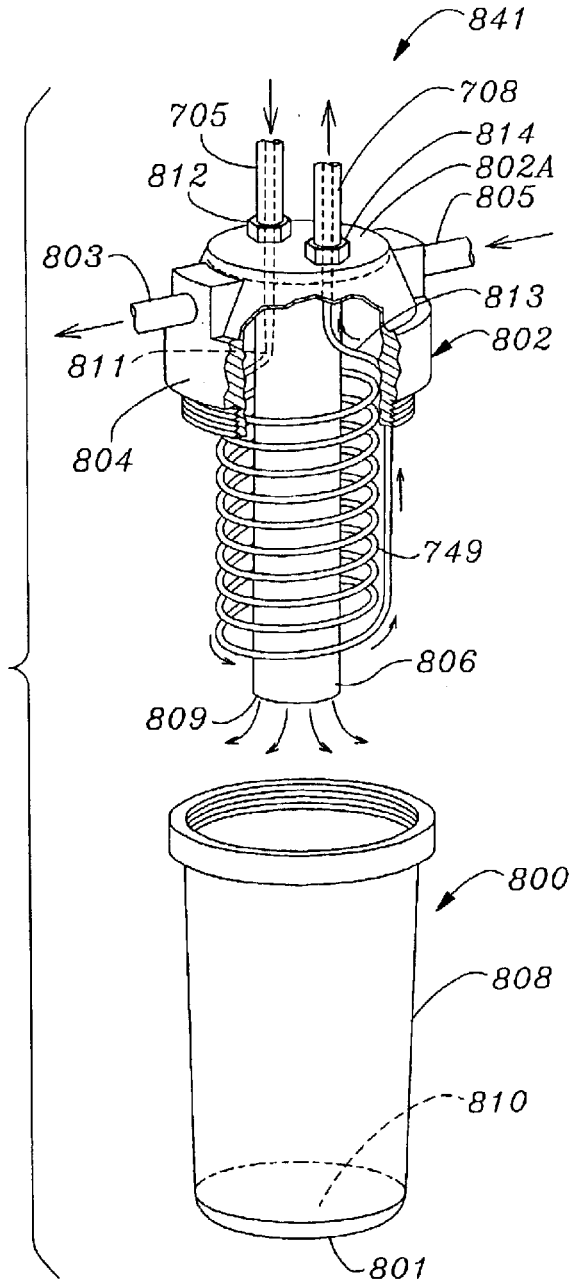
FIG. 20 is an exploded view of the heat exchanger/condenser of FIG. 19.
Figure 21:
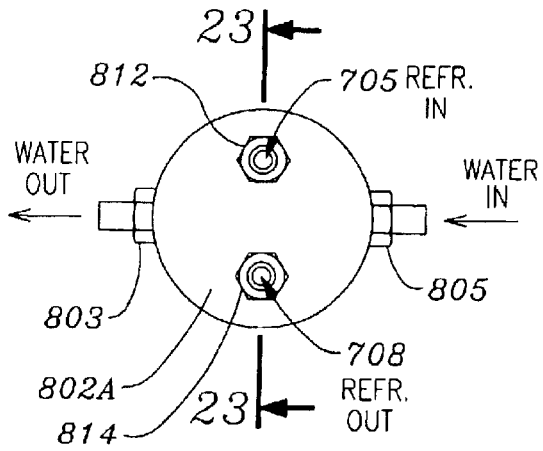
FIG. 21 is an upper plan view of the heat exchanger/condenser of FIG. 19.
Figure 23:
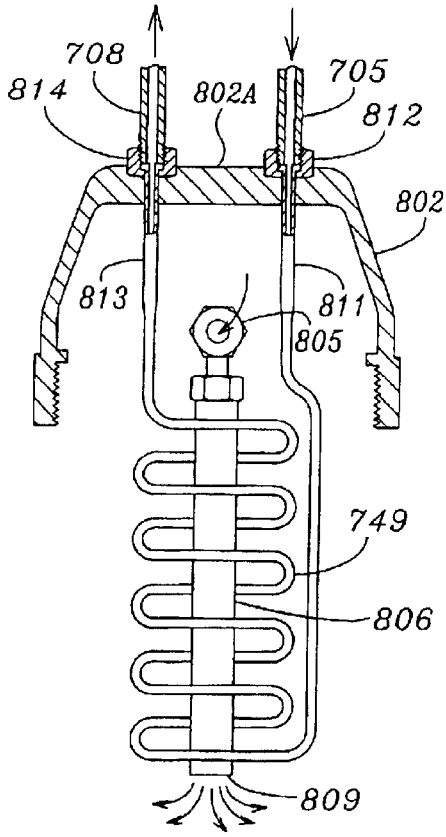
FIG. 23 is a fragmentary vertical sectional view of the heat exchanger/condenser of FIG. 21, taken in the direction of line 23—23.

In an example embodiment of modified heat exchanger assembly 699 each heat exchanger/condenser 741, 747, 751 was replaced by a modified condenser 841, as shown in FIGS. 19 to 23. Modified condenser had the shape of a circular cylindrical tank 800 which had a height of about 12½ inches and an inner diameter of about 4–½ inches. As shown in FIGS. 19 and 20, each modified condenser 841 has a circular disk-shaped base 801, a circular cup-shaped upper cover or bulkhead 802, and a radially disposed water outlet port tube 803 which penetrates the cylindrical wall surface 804 of the bulkhead and which is located below and adjacent to the upper surface 802A of the bulkhead. Also, as shown in FIGS. 19 and 20, condenser tank 800 has a water inlet port tube 805 which is diametrically opposed to and radially aligned with water outlet port tube 803, thus penetrating a diametrically opposed portion of cylindrical wall surface 804 of bulkhead 802.

Figure 22:
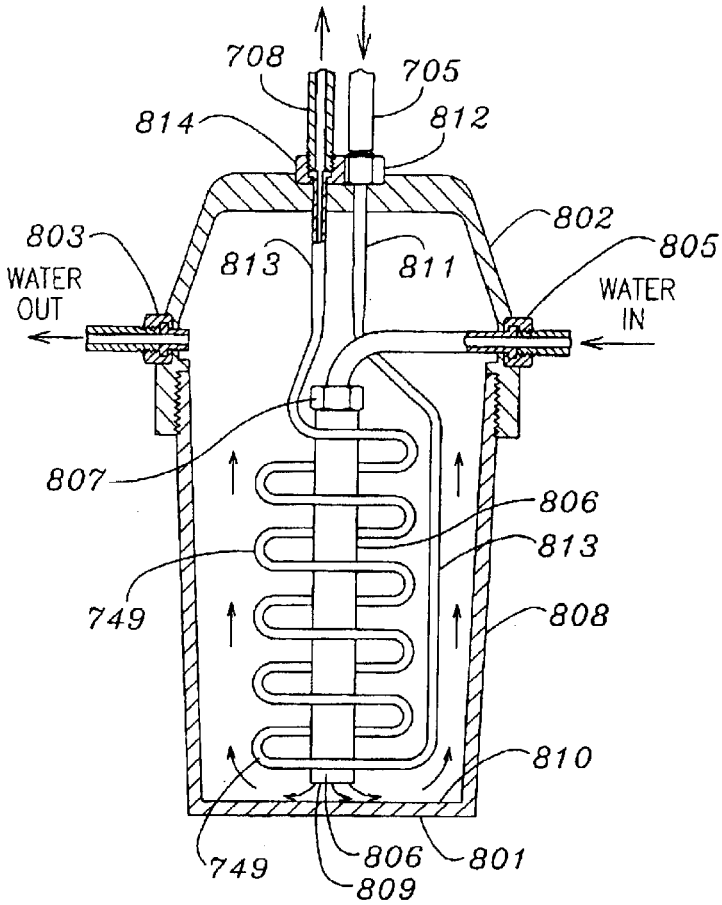
FIG. 22 is a vertical sectional view of the heat exchanger/condenser of FIG. 1 taken in the direction of line 22—22.

As may be seen best by referring to FIG. 22, condenser tank 800 includes a cylindrically-shaped distribution tube 806 which depends longitudinally downwardly from a fitting 807 located at a radially inwardly end of water inlet port tube 805, coaxial with outer cylindrical wall surface 804 of the bulkhead and outer cylindrical wall surface 808 of tank 800. In an example embodiment of tank 800, water inlet and outer port tubes 805, 803 had a diameter of about ¼ inch, and distribution tube 806 had a diameter of about ¾ inch, and was fabricated from PVC tubing. Also in the example embodiment, distribution tube 806 had a lower annular end wall 809 which was located about ½ inch above upper, inner surface 810 of tank base 801.

Referring still to FIGS. 19, 20, 22 and 23, helical coil 749 of water heat exchanger condenser 747 in the present example included a length of about 40 to 46 feet of ¼ inch copper tubing which was wound in a helical spiral containing about 40–60 turns around distribution tube 806. As shown in the figures, pressurized refrigerant inlet line 705 is coupled to a first, inlet end 811 of helical coil 749 by an inlet coupling 812 which penetrates bulkhead 802 of tank 800. Also, a second, outlet end 813 of helical coil 749 is coupled to outlet line 708 of condenser 747 by an outlet coupling 814 which penetrates bulkhead 802 of tank 800. FIG. 15 summarizes temperatures and flow rates of water and refrigerant through modified heat exchanger 699, as well as approximate relative percentages of vapor and liquid phases of refrigerant at various places in the heat exchanger.

What is claimed is:

1. An air conditioning apparatus for controlling properties of air in an isolated space, said apparatus comprising;

A. a cooling enclosure having an inlet side, an interior, and an outlet side,

B. a fan for moving air from said inlet side through said interior to said outlet side of said enclosure, C. an evaporative cooler within said interior of said enclosure, D. at least one spray nozzle connected to a water inlet conduit for supplying water to said evaporative cooler, E. a drip tray for collecting water issuing from said evaporative cooler which does not evaporate, F. a water outlet conduit for discharging said collected water to a location exterior to said isolated space, and G. at least a first refrigeration apparatus for refrigerating air flowing through said enclosure, said first refrigeration apparatus including;

I. a refrigerant compressor charged with a refrigerant,

II. at least a first refrigerant-to-water heat exchanger/condenser which includes a housing that has a pressurized refrigerant inlet coupling connected by a refrigerant input line to a pressurized outlet port of said compressor, a length of coiled tubing within a chamber inside said housing coupled at a first end to said refrigerant inlet coupling and at a second end thereof to a refrigerant outlet coupling, a water inlet port and a water outlet port which both communicate with said housing chamber, a water source inlet tube connected to said water inlet port, and a water discharge tube connected to said water outlet port, and III. a first refrigerant evaporator located within said cooling enclosure spaced longitudinally apart from said evaporative cooler, said evaporator having a serpentinely curved refrigerant flow path having an evaporator inlet port coupled through a pressurized refrigerant supply line to said outlet coupling of said condenser, said evaporator flow path having a larger flow cross section than that of said pressurized refrigerant supply line, and an evaporator outlet port coupled through a low pressure outlet suction line to a suction inlet port of said compressor.

2.The air conditioning apparatus of claim 1 wherein said water outlet conduit is further described as connecting to a drain location exterior to said isolated space.

3. The air conditioning apparatus of claim 1 wherein said first refrigerant evaporator is located between said inlet side of said enclosure and said evaporative cooler.

4. The air conditioning apparatus of claim 1 wherein said first refrigerant evaporator is located between said outlet side of said enclosure and said evaporative cooler.

5. The air conditioning apparatus of claim 1 further including a second refrigeration apparatus for refrigerating air flowing through said enclosure, said second refrigeration apparatus including a second evaporator located within said enclosure spaced longitudinally apart from said evaporative cooler on a side thereof opposite that of said first evaporator.

6. The air conditioning apparatus of claim 1 wherein said housing of said refrigerant-to-water heat exchanger is further described as including a tank having an enclosed hollow interior space comprising said chamber which communicates with said water inlet port and said outlet port, and fluid pressure-tight pass-through fittings which communicate with said pressurized refrigerant input and output couplings and said length of coiled tubing within said housing.

7. The air conditioning apparatus of claim 6 wherein said water inlet port and said water outlet port of said refrigerant-to-water heat exchanger are further defined as being disposed through a bulkhead of said tank.

8. The air conditioning apparatus of claim 7 wherein said refrigerant-to-water heat exchanger is further defined as having a distribution tube disposed longitudinally within said tank, said distribution tube having a lower transverse open end adjacent to an upper inner surface of said lower base wall of said tank, and an inlet opening coupled in fluid communication with one of said water inlet and outlet ports.

9. The air conditioning apparatus of claim 8 wherein said coiled tubing of said pressurized refrigerant line is further defined as being helically disposed around said distribution tube.

10. The air conditioning apparatus of claim 9 wherein said water inlet and outlet ports of said heat exchanger are further described as being located near an upper wall surface of said upper bulkhead of said tank.

11. The air conditioning apparatus of claim 1 further including a second refrigerant-to-water heat exchanger/condenser which has a water outlet port and a water inlet port coupled to said water outlet port of said first refrigerant-to-water heat exchanger/condenser, a pressurized refrigerant input coupling connected by a pressurized refrigerant input line to a compressor-side source of pressurized refrigerant and an outlet refrigerant coupling connected by an outlet line to an evaporator-side destination for pressurized refrigerant.

12. The air conditioner apparatus of claim 11 further including a third refrigerant-to-water heat exchanger which has a water outlet port and water inlet port coupled to said water outlet port of said second refrigerant-to-water heat exchanger/condenser, a pressurized refrigerant input coupling connected by a pressurized input line to a compressor-side source of pressurized refrigerant and an outlet refrigerant coupling connected by an outlet line to an evaporator-side destination for pressurized refrigerant.

13. The air conditioning apparatus of claim 12 further including a first, inlet tee fitting having an inlet bore connected to said compressor-side source of pressurized refrigerant, a first outlet bore connected to said refrigerant inlet coupling of said second heat exchanger, a second outlet bore connected to said refrigerant inlet coupling of said third heat exchanger, a second, outlet tee fitting having a first inlet bore connected to said refrigerant outlet coupling of said second heat exchanger, a second inlet bore connected to said refrigerant outlet coupling of said third heat exchanger, and an outlet bore connected to said refrigerant inlet coupling of said first heat exchanger.

14. The air conditioning apparatus of claim 13 wherein said water inlet port of said first heat exchanger is connected to a source of water, said water outlet port of said first heat exchanger is connected to said water inlet port of said second heat exchanger, said water outlet port of said second heat exchanger is connected to said water inlet port of said third heat exchanger, and said water outlet port of said third heat exchanger is connected to a water discharge location.

15. An air conditioning apparatus for controlling properties of air in an isolated space, said apparatus comprising;

a. a cooling enclosure having an inlet side, an interior, and an outlet side, b. a fan for moving air from said inlet side through said interior to said outlet side of said enclosure, c. at least a first refrigerant apparatus for refrigerating and/or dehumidifying air flowing said enclosure, said first refrigeration apparatus including, (I) a refrigerant compressor charged with a refrigerant, (ii) at least a first refrigerator-to-water heat exchanger/condenser which includes a housing that has a pressurized refrigerant input coupling connected by a refrigerant input line to a pressurized outlet port of said compressor, a length of coiled tubing within a chamber inside said housing coupled at a first end to said refrigerant inlet coupling and at a second end thereof to a refrigerant outlet coupling, a water inlet port and a water outlet port which both communicate with said housing chamber, a water inlet conduit connected to said water inlet port and a water outlet conduit connected to said water outlet port, and (iii) a first refrigerant evaporator located within said cooling enclosure, said evaporator having a serpentinely curved refrigerant-flow path having an inlet port coupled through a pressurized refrigerant supply line to said outlet coupling of said condenser, said evaporator flow path having a larger flow cross section than that of said pressurized refrigerant supply line, and an outlet port coupled through a low pressure outlet suction line to a suction inlet port of said compressor.

16. The air conditioning apparatus of claim 15 wherein said water outlet conduit is further described as connecting to a drain location exterior to said isolated space.

17. The air conditioning apparatus of claim 15 wherein said housing of said refrigerant-to-water heat exchanger is further described as including a tank having an enclosed hollow interior space comprising said chamber which communicates with said water inlet port and said outlet port, and fluid pressure-tight pass-through fittings which communicate with said pressurized refrigerant input and output couplings and said length of coiled tubing within said housing.

18. The air conditioning apparatus of claim 17 wherein said water inlet port and said water outlet port of said refrigerant-to-water heat exchanger are further defined as being disposed through a bulkhead of said tank.

19. The air conditioning apparatus of claim 18 wherein said refrigerant-to-water heat exchanger is further defined as having a distribution tube disposed longitudinally within said tank, said distribution tube having a lower transverse end adjacent to an upper inner surface of said lower base wall of said tank, and an inlet opening coupled in fluid communication with one of said water inlet and outlet ports.

20. The air conditioning apparatus of claim 19 wherein said coiled tubing of said pressurized refrigerant line is further defined as being helically disposed around said distribution tube.

21. The air conditioning apparatus of claim 20 wherein said water inlet and outlet ports of said heat exchanger are further described as being located near an upper wall surface of said upper bulkhead of said tank.

22. The air conditioning apparatus of claim 15 further including a second refrigerant-to-water heat exchanger/condenser which has a water outlet port and a water inlet port coupled to said water outlet port of said first refrigerant-to-water heat exchanger/condenser, a pressurized refrigerant input coupling connected by a pressurized refrigerant input line to a compressor-side source of pressurized refrigerant and an outlet refrigerant coupling connected by an outlet line to an evaporator-side destination for pressurized refrigerant.

23. The air conditioner apparatus of claim 22 further including a third refrigerant-to-water heat exchanger which has a water outlet port and water inlet port coupled to said water outlet port of said second refrigerant-to-water heat exchanger/condenser, a pressurized refrigerant input coupling connected by a pressurized input line to a compressor-side source of pressurized refrigerant and an outlet refrigerant coupling connected by an outlet line to an evaporator-side destination for pressurized refrigerant.

24. The air conditioning apparatus of claim 23 further including a first, inlet tee fitting having an inlet bore connected to said compressor-side source of pressurized refrigerant, a first outlet bore connected to said refrigerant inlet coupling of said second heat exchanger, a second outlet bore connected to said refrigerant inlet coupling of said third heat exchanger, a second, outlet tee fitting having a first inlet bore connected to said refrigerant outlet coupling of said second heat exchanger, a second inlet bore connected to said refrigerant outlet coupling of said third heat exchanger, and an outlet bore connected to said refrigerant inlet coupling of said first heat exchanger.

25. The air conditioning apparatus of claim 24 wherein said water inlet port of said first heat exchanger is connected to a source of water, said water outlet port of said first heat exchanger is connected to said water inlet port of said second heat exchanger, said water outlet port of said second heat exchanger is connected to said water inlet port of said third heat exchanger, and said water outlet port of said third heat exchanger is connected to a water discharge location.

26. A refrigerant heat exchanger/condenser assembly having at least a first refrigerant-to-water heat changer/condenser which includes a housing that has a pressurized refrigerant inlet coupling connectable by a refrigerant input line to a pressurized outlet port of a refrigerant-charged compressor, a length of coiled tubing within a chamber inside said housing coupled at a first end to said refrigerant inlet coupling and at a second end thereof to a refrigerant outlet coupling, a water inlet port and a water outlet port which both communicate with said housing chamber, water source means connected to said water inlet port, and a water discharge means connected to said water outlet port.

27. The assembly of claim 26 further including a second refrigerant-to-water heat exchanger/condenser which has a water outlet port and a water inlet port coupled to said water outlet port of said first refrigerant-to-water heat exchanger/condenser, a pressurized refrigerant input coupling connectable by a pressurized refrigerant input line to a compressor-side source of pressurized refrigerant and an outlet refrigerant coupling connectable by an outlet line to an evaporator-side destination for pressurized refrigerant.

28. The assembly of claim 27 further including a third refrigerant-to-water heat exchanger which has a water outlet port and water inlet port coupled to said water outlet port of said second refrigerant-to-water heat exchanger/condenser, a pressurized refrigerant input coupling connectable by a pressurized input line to a compressor-side source of pressurized refrigerant and an outlet refrigerant coupling connectable by an outlet line to an evaporator-side destination for pressurized refrigerant.

29. The assembly of claim 28 further including a first, inlet tee fitting having an inlet bore connectable to said compressor-side source of pressurized refrigerant, a first outlet bore connected to said refrigerant inlet coupling of said second heat exchanger, a second outlet bore connected to said refrigerant inlet coupling of said third heat exchanger, a second, outlet tee fitting having a first inlet bore connected to said refrigerant outlet coupling of said second heat exchanger, a second inlet bore connected to said refrigerant outlet coupling of said third heat exchanger, and an outlet bore connected to said refrigerant inlet coupling of said first heat exchanger.

30. The assembly of claim 29 wherein said water inlet port of said first heat exchanger is connected to a source of water, said water outlet port of said first heat exchanger is connected to said water inlet port of said second heat exchanger, said water outlet port of said second heat exchanger is connected to said water inlet port of said third heat exchanger, and said water outlet port of said third heat exchanger is connected to a water discharge location.

31. An air conditioning apparatus for controlling properties of air in an isolated space, said apparatus comprising, h. a cooling enclosure having an inlet side, an interior, and an outlet side, a fan for moving air from said inlet side through said interior to said outlet side of said enclosure, j. an evaporative cooler within said interior of said enclosure, k. means for supplying water to said evaporative cooler, l. means for collecting water issuing from said evaporative cooler which does not evaporate, m. means for discharging said collected water to a location exterior to said isolated space, and n. a spray eliminator structure for removing moisture droplets in an air stream flowing from said evaporative cooler to said outlet side of said enclosure, said spray eliminator structure comprising a plate having through its thickness dimension a plurality of perforations, said plate being disposed transversely to a longitudinal axis of said enclosure parallel to said air stream flow through said enclosure, said plate being located downstream of said evaporative cooler.

* * * * *